US011913334B2

(12) United States Patent
Zalluhoglu et al.

(10) Patent No.: US 11,913,334 B2
(45) Date of Patent: Feb. 27, 2024

(54) DOWNHOLE CONTROLLER ASSISTED DRILLING OF A CONSTANT CURVATURE IN A BOREHOLE

(71) Applicant: Halliburton Energy Services, Inc., Houston, TX (US)

(72) Inventors: Umut Zalluhoglu, Humble, TX (US); Wei Zhang, Humble, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 455 days.

(21) Appl. No.: 16/879,040

(22) Filed: May 20, 2020

(65) Prior Publication Data

US 2021/0363828 A1 Nov. 25, 2021

(51) Int. Cl.
*E21B 7/06* (2006.01)
*E21B 44/00* (2006.01)

(52) U.S. Cl.
CPC ..... *E21B 7/06* (2013.01); *E21B 44/00* (2013.01); *E21B 44/005* (2013.01)

(58) Field of Classification Search
CPC ..... E21B 7/06; E21B 44/005
See application file for complete search history.

(56) References Cited

U.S. PATENT DOCUMENTS

| | | | |
|---|---|---|---|
| 7,957,946 B2 | 6/2011 | Pirovolou | |
| 8,672,055 B2 | 3/2014 | Boone et al. | |
| 8,694,257 B2 | 4/2014 | Zamanian et al. | |
| 9,404,355 B2 | 8/2016 | Bayliss | |
| 9,835,020 B2 | 12/2017 | Bayliss et al. | |
| 9,945,222 B2 | 4/2018 | Sugiura et al. | |
| 10,001,004 B2 | 6/2018 | Bayliss et al. | |
| 2008/0294343 A1* | 11/2008 | Sugiura | E21B 47/022 702/6 |

(Continued)

FOREIGN PATENT DOCUMENTS

| | | |
|---|---|---|
| CA | 2837978 | 1/2019 |
| WO | 2018-152636 | 8/2018 |
| WO | 2019222720 | 11/2019 |

OTHER PUBLICATIONS

International Search Report and Written Opinion for Application No. PCT/US2020/035277, dated Feb. 16, 2021.

*Primary Examiner* — Dany E Akakpo
(74) *Attorney, Agent, or Firm* — Benjamin Ford; C. Tumey Law Group PLLC

(57) ABSTRACT

A method for controlling a rotary steerable system (RSS) may comprise disposing the RSS into a borehole, storing a curvature for the borehole into an information handling system, storing one or more steering commands in the information handling system, taking a first attitude measurement at a first sensor and a second sensor disposed on the RSS at a first location in the borehole, and calculating a first relative attitude from the first attitude measurement at the first sensor and the second sensor. The method may further comprise taking a second attitude measurement at the first sensor and the second sensor disposed on the RSS at the second location in the borehole, calculating a second relative attitude from the second attitude measurement at the first sensor and the second sensor, and comparing the first relative attitude to the second relative attitude to find a difference.

20 Claims, 7 Drawing Sheets

(56) References Cited

U.S. PATENT DOCUMENTS

| | | | | |
|---|---|---|---|---|
| 2009/0260884 | A1* | 10/2009 | Santelmann | E21B 44/00 175/74 |
| 2012/0247833 | A1 | 10/2012 | Ekseth et al. | |
| 2012/0330551 | A1* | 12/2012 | Mitchell | E21B 47/022 702/9 |
| 2015/0096805 | A1 | 4/2015 | Kruspe et al. | |
| 2015/0330209 | A1 | 11/2015 | Panchal et al. | |
| 2016/0160628 | A1 | 6/2016 | Sugiura et al. | |
| 2019/0085680 | A1 | 3/2019 | Maus et al. | |
| 2019/0169974 | A1 | 6/2019 | Melo Uribe et al. | |
| 2019/0169977 | A1 | 6/2019 | Maus et al. | |
| 2019/0169979 | A1 | 6/2019 | Nguyen et al. | |
| 2019/0186253 | A1 | 6/2019 | Peter et al. | |
| 2019/0353023 | A1 | 11/2019 | Whitacre et al. | |
| 2020/0080380 | A1* | 3/2020 | Gorrara | E21B 7/04 |

* cited by examiner

DOWNHOLE CONTROLLER ASSISTED DRILLING OF A CONSTANT CURVATURE IN A BOREHOLE

BACKGROUND

In order to obtain hydrocarbons such as oil and gas, boreholes are drilled through hydrocarbon-bearing subsurface formations. During drilling operations, directionally drilling operations may by performed where the drilling direction may veer of an intended drilling path at an angle or even horizontally away from the drilling path. Directional drilling of a subterranean well may be relatively complex and involve considerable expense. Most of these operations are done by hand with experienced operators running the drilling platform. There is a continual effort in the industry to develop improvement in safety, cost minimization, and efficiency. The advancements of computerized and automated systems in drilling processes are the next step in achieving these goals.

During drilling operations, creating a constant curvature, when transitioning from a vertical to horizontal wellbore, or vice versa, is performed with commands generated on the surface. These commands are sent to a rotary steerable system that guides a drill bit and bottom hole assembly. Due to communication induced delays and human error, changes to the generated curvature are noticed and acted upon behind actual drilling operations. This may lead to over/under-correction that may least to a tortuous borehole. This may lead to saying behind a drilling plan and failing to achieve the objective of hitting a target within reasonable threshold.

BRIEF DESCRIPTION OF THE DRAWINGS

These drawings illustrate certain aspects of some examples of the present disclosure and should not be used to limit or define the disclosure.

DETAILED DESCRIPTION

Described below are methods and systems for creating a constant curvature in a borehole with a rotary steerable tool ("RSS"). The proposed systems and methods include a feedback loop for constant corrections to drilling operations with the RSS. Specifically, utilizing one or more attitude measurements from one or more spatially distributed sensors along a bottom hole assembly may be used to regulate steering commands provided to a tool face controller that controls the RSS. This may maintain a constant curvature while drilling a curve section of the borehole with the RSS.

Figure 1:
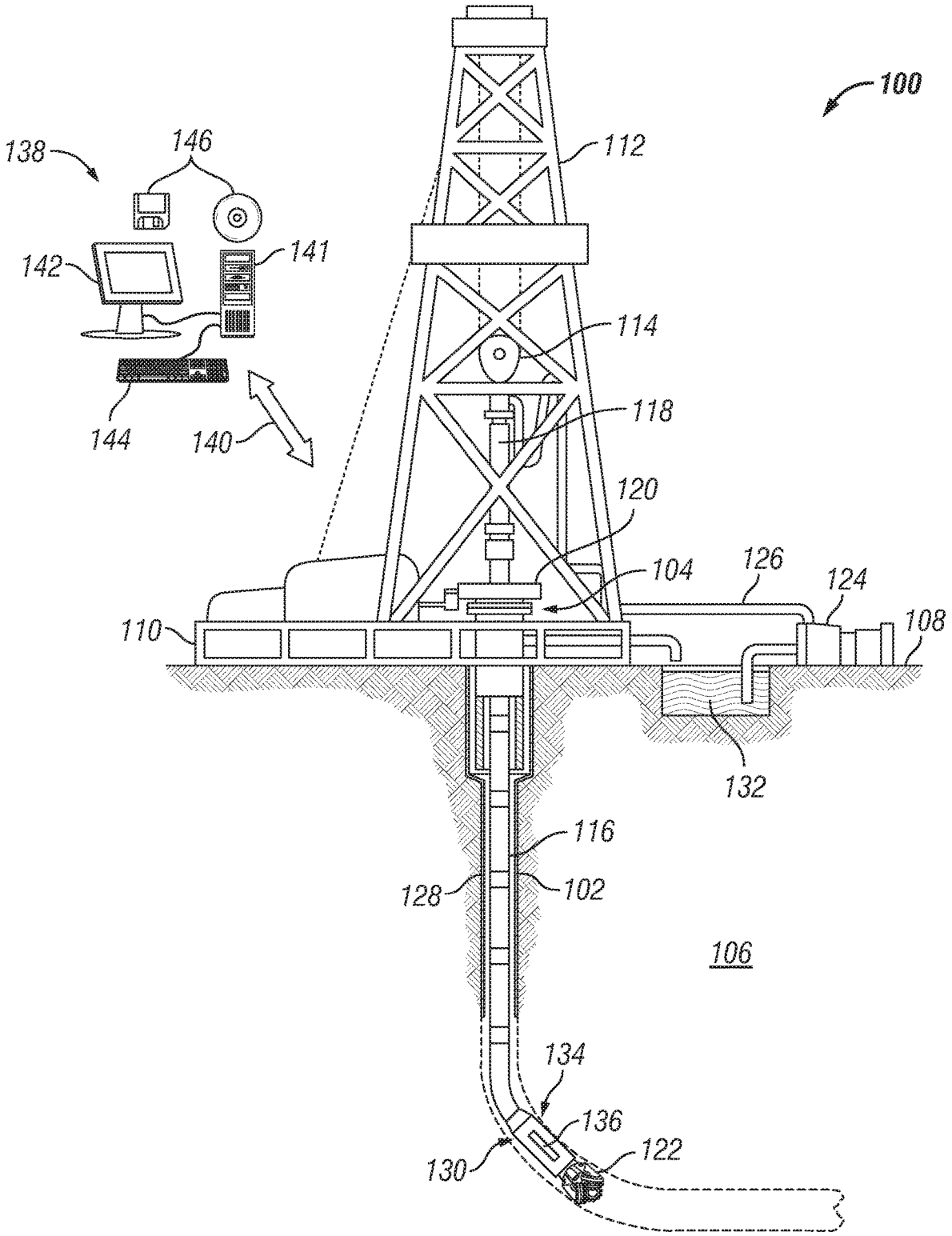
FIG. 1 illustrate an example of a drilling system.

FIG. 1 illustrates a drilling system 100 in accordance with example embodiments. As illustrated, borehole 102 may extend from a wellhead 104 into a subterranean formation 106 from a surface 108. Generally, borehole 102 may include horizontal, vertical, slanted, curved, and other types of borehole geometries and orientations. Borehole 102 may be cased or uncased. In examples, borehole 102 may include a metallic member. By way of example, the metallic member may be a casing, liner, tubing, or other elongated steel tubular disposed in borehole 102.

As illustrated, borehole 102 may extend through subterranean formation 106. As illustrated in FIG. 1, borehole 102 may extend generally vertically into the subterranean formation 106, however borehole 102 may extend at an angle through subterranean formation 106, such as horizontal and slanted boreholes. For example, although FIG. 1 illustrates a vertical or low inclination angle well, high inclination angle or horizontal placement of the well and equipment may be possible. It should further be noted that while FIG. 1 generally depict land-based operations, those skilled in the art may recognize that the principles described herein are equally applicable to subsea operations that employ floating or sea-based platforms and rigs, without departing from the scope of the disclosure.

As illustrated, a drilling platform 110 may support a derrick 112 having a traveling block 114 for raising and lowering drill string 116. Drill string 116 may include, but is not limited to, drill pipe and coiled tubing, as generally known to those skilled in the art. A kelly 118 may support drill string 116 as it may be lowered through a rotary table 120. A drill bit 122 may be attached to the distal end of drill string 116 and may be driven either by a downhole motor and/or via rotation of drill string 116 from surface 108. Without limitation, drill bit 122 may include, roller cone bits, PDC bits, natural diamond bits, any hole openers, reamers, coring bits, and the like. As drill bit 122 rotates, it may create and extend borehole 102 that penetrates various subterranean formations 106. A pump 124 may circulate drilling fluid through a feed pipe 126 through kelly 118, downhole through interior of drill string 116, through orifices in drill bit 122, back to surface 108 via annulus 128 surrounding drill string 116, and into a retention pit 132.

With continued reference to FIG. 1, drill string 116 may begin at wellhead 104 and may traverse borehole 102. Drill bit 122 may be attached to a distal end of drill string 116 and may be driven, for example, either by a downhole motor and/or via rotation of drill string 116 from surface 108. Drill bit 122 may be a part of a rotary steerable system (RSS) 130 at distal end of drill string 116. RSS 130 may further include tools for real-time health assessment of a rotary steerable tool during drilling operations. As will be appreciated by those of ordinary skill in the art, RSS 130 may be a measurement-while drilling (MWD) or logging-while-drilling (LWD) system.

RSS 130 may comprise any number of tools, such as sensors, transmitters, and/or receivers to perform downhole measurement operations or to perform real-time health assessment of a rotary steerable tool during drilling operations. For example, as illustrated in FIG. 1, RSS 130 may include a bottom hole assembly (BHA) 134. It should be noted that BHA 134 may make up at least a part of RSS 130. Without limitation, any number of different measurement assemblies, communication assemblies, battery assemblies, and/or the like may form RSS 130 with BHA 134. Additionally, BHA 134 may form RSS 130 itself. In examples, BHA 134 may comprise one or more sensors 136. Sensors 136 may be connected to information handling system 138, discussed below, which may further control the operation of sensors 136. Sensors 136 may include, accelerometers, gyroscopes, magnetometers, strain gauges, gamma ray, resistivity sensor, temperature sensor, and/or the like). During operations, sensors 136 may process real time data originating from various sources such as diagnostics data, sensors measurements, operational data, and/or the like. Information and/or measurements may be processed further by information handling system 138 to determine real time heal assessment of rotary steerable tool.

Without limitation, RSS 130 may be connected to and/or controlled by information handling system 138, which may be disposed on surface 108. Without limitation, information handling system 138 may be disposed downhole in RSS 130. Processing of information recorded may occur downhole and/or on surface 108. Processing occurring downhole may be transmitted to surface 108 to be recorded, observed, and/or further analyzed. Additionally, information recorded on information handling system 138 that may be disposed downhole may be stored until RSS 130 may be brought to surface 108. In examples, information handling system 138 may communicate with RSS 130 through a communication line (not illustrated) disposed in (or on) drill string 116. In examples, wireless communication may be used to transmit information back and forth between information handling system 138 and RSS 130. Information handling system 138 may transmit information to RSS 130 and may receive as well as process information recorded by RSS 130. In examples, a downhole information handling system (not illustrated) may include, without limitation, a microprocessor or other suitable circuitry, for estimating, receiving and processing signals from RSS 130. Downhole information handling system (not illustrated) may further include additional components, such as memory, input/output devices, interfaces, and the like. In examples, while not illustrated, RSS 130 may include one or more additional components, such as analog-to-digital converter, filter and amplifier, among others, that may be used to process the measurements of RSS 130 before they may be transmitted to surface 108. Alternatively, raw measurements from RSS 130 may be transmitted to surface 108.

Any suitable technique may be used for transmitting signals from RSS 130 to surface 108, including, but not limited to, wired pipe telemetry, mud-pulse telemetry, acoustic telemetry, and electromagnetic telemetry. While not illustrated, RSS 130 may include a telemetry subassembly that may transmit telemetry data to surface 108. At surface 108, pressure transducers (not shown) may convert the pressure signal into electrical signals for a digitizer (not illustrated). The digitizer may supply a digital form of the telemetry signals to information handling system 138 via a communication link 140, which may be a wired or wireless link. The telemetry data may be analyzed and processed by information handling system 138.

As illustrated, communication link 140, which may be wired, wireless, mud pulse communication, or any other suitable form of communication known in the art, may be provided that may transmit data from RSS 130 to an information handling system 138 at surface 108. Information handling system 138 may include a personal computer 141, a video display 142, a keyboard 144 (i.e., other input devices), and/or non-transitory computer-readable media 146 (e.g., optical disks, magnetic disks) that can store code representative of the methods described herein. In addition to, or in place of processing at surface 108, processing may occur downhole as information handling system 138 may be disposed on RSS 130. Likewise, information handling system 138 may process measurements taken by one or more sensors 136 automatically or send information from sensors 136 to the surface. As discussed above, the software, algorithms, and modeling is performed by information handling system 138. Information handling system 138 may perform steps, run software, perform calculations, and/or the like automatically, through automation (such as through artificial intelligence ("AI"), dynamically, in real-time, and/or substantially in real-time.

Figure 2:
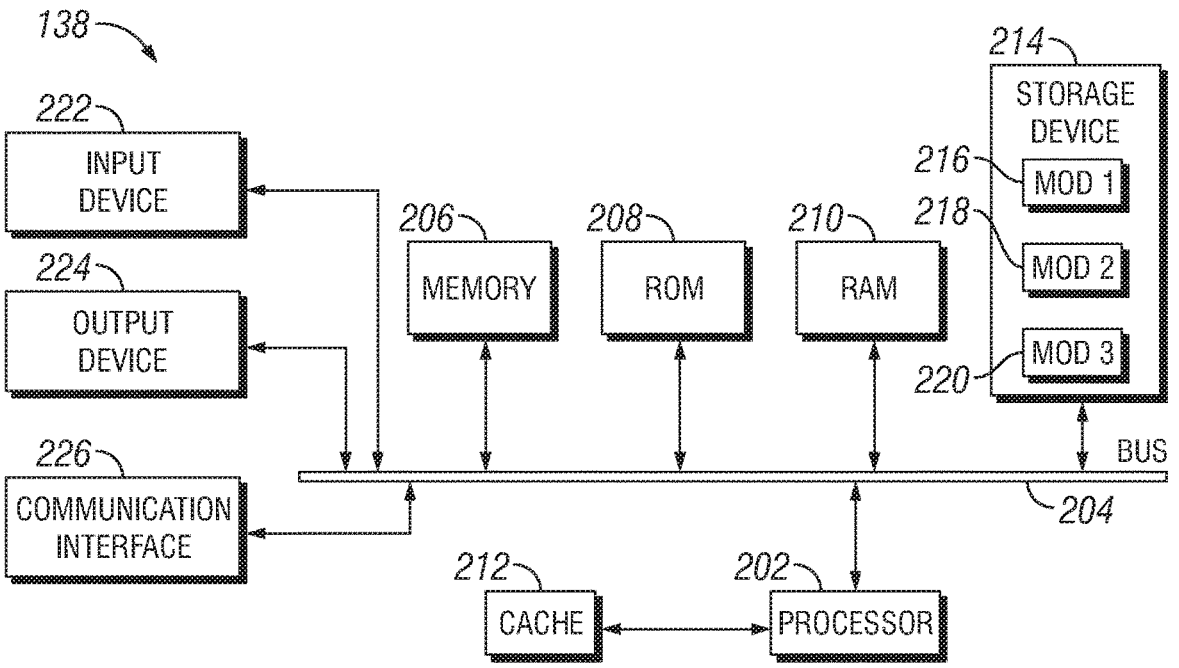
FIG. 2 is a schematic view of an information handling system.

FIG. 2 illustrates an example information handling system 138 which may be employed to perform various steps, methods, and techniques disclosed herein in accordance with some embodiments. Persons of ordinary skill in the art will readily appreciate that other system examples are possible. As illustrated, information handling system 138 includes a processing unit (CPU or processor) 202 and a system bus 204 that couples various system components including system memory 206 such as read only memory (ROM) 208 and random access memory (RAM) 210 to processor 202. Processors disclosed herein may all be forms of this processor 202. Information handling system 138 may include a cache 212 of high-speed memory connected directly with, in close proximity to, or integrated as part of processor 202. Information handling system 138 copies data from memory 206 and/or storage device 214 to cache 212 for quick access by processor 202. In this way, cache 212 provides a performance boost that avoids processor 202 delays while waiting for data. These and other modules may control or be configured to control processor 202 to perform various operations or actions. Other system memory 206 may be available for use as well. Memory 206 may include multiple different types of memory with different performance characteristics. It may be appreciated that the disclosure may operate on information handling system 138 with more than one processor 202 or on a group or cluster of computing devices networked together to provide greater processing capability. Processor 202 may include any general purpose processor and a hardware module or software module, such as first module 216, second module 218, and third module 220 stored in storage device 214, configured to control processor 202 as well as a special-purpose processor where software instructions are incorporated into processor 202. Processor 202 may be a self-contained computing system, containing multiple cores or processors, a bus, memory controller, cache, etc. A multi-core processor may be symmetric or asymmetric. Processor 202 may include multiple processors, such as a system having multiple, physically separate processors in different sockets, or a system having multiple processor cores on a single physical chip. Similarly, processor 202 may include multiple distributed processors located in multiple separate computing devices, but working together such as via a communications network. Multiple processors or processor cores may share resources such as memory 206 or cache 212, or may operate using independent resources. Processor 202 may include one or more state machines, an application specific integrated circuit (ASIC), or a programmable gate array (PGA) including a field PGA (FPGA).

Each individual component discussed above may be coupled to system bus 204, which may connect each and every individual component to each other. System bus 204 may be any of several types of bus structures including a memory bus or memory controller, a peripheral bus, and a local bus using any of a variety of bus architectures. A basic input/output (BIOS) stored in ROM 208 or the like, may provide the basic routine that helps to transfer information between elements within information handling system 138, such as during start-up. Information handling system 138 further includes storage devices 214 or computer-readable storage media such as a hard disk drive, a magnetic disk drive, an optical disk drive, tape drive, solid-state drive, RAM drive, removable storage devices, a redundant array of inexpensive disks (RAID), hybrid storage device, or the like. Storage device 214 may include software modules 216, 218, and 220 for controlling processor 202. Information handling system 138 may include other hardware or software modules. Storage device 214 is connected to the system bus 204 by a drive interface. The drives and the associated computer-readable storage devices provide nonvolatile storage of computer-readable instructions, data structures, program modules and other data for information handling system 138. In one aspect, a hardware module that performs a particular function includes the software component stored in a tangible computer-readable storage device in connection with the necessary hardware components, such as processor 202, system bus 204, and so forth, to carry out a particular function. In another aspect, the system may use a processor and computer-readable storage device to store instructions which, when executed by the processor, cause the processor to perform operations, a method or other specific actions. The basic components and appropriate variations may be modified depending on the type of device, such as whether information handling system 138 is a small, handheld computing device, a desktop computer, or a computer server. When processor 202 executes instructions to perform "operations", processor 202 may perform the operations directly and/or facilitate, direct, or cooperate with another device or component to perform the operations.

As illustrated, information handling system 138 employs storage device 214, which may be a hard disk or other types of computer-readable storage devices which may store data that are accessible by a computer, such as magnetic cassettes, flash memory cards, digital versatile disks (DVDs), cartridges, random access memories (RAMs) 210, read only memory (ROM) 208, a cable containing a bit stream and the like, may also be used in the exemplary operating environment. Tangible computer-readable storage media, computer-readable storage devices, or computer-readable memory devices, expressly exclude media such as transitory waves, energy, carrier signals, electromagnetic waves, and signals per se.

To enable user interaction with information handling system 138, an input device 222 represents any number of input mechanisms, such as a microphone for speech, a touch-sensitive screen for gesture or graphical input, keyboard, mouse, motion input, speech and so forth. Additionally, input device 222 may take in data from one or more sensors 136, discussed above. An output device 224 may also be one or more of a number of output mechanisms known to those of skill in the art. In some instances, multimodal systems enable a user to provide multiple types of input to communicate with information handling system 138. Communications interface 226 generally governs and manages the user input and system output. There is no restriction on operating on any particular hardware arrangement and therefore the basic hardware depicted may easily be substituted for improved hardware or firmware arrangements as they are developed.

As illustrated, each individual component describe above is depicted and disclosed as individual functional blocks. The functions these blocks represent may be provided through the use of either shared or dedicated hardware, including, but not limited to, hardware capable of executing software and hardware, such as a processor 202, that is purpose-built to operate as an equivalent to software executing on a general purpose processor. For example, the functions of one or more processors presented in FIG. 2 may be provided by a single shared processor or multiple processors. (Use of the term "processor" should not be construed to refer exclusively to hardware capable of executing software.) Illustrative embodiments may include microprocessor and/or digital signal processor (DSP) hardware, read-only memory (ROM) 208 for storing software performing the operations described below, and random access memory (RAM) 210 for storing results. Very large scale integration (VLSI) hardware embodiments, as well as custom VLSI circuitry in combination with a general purpose DSP circuit, may also be provided.

The logical operations of the various methods, described below, are implemented as: (1) a sequence of computer implemented steps, operations, or procedures running on a programmable circuit within a general use computer, (2) a sequence of computer implemented steps, operations, or procedures running on a specific-use programmable circuit; and/or (3) interconnected machine modules or program engines within the programmable circuits. Information handling system 138 may practice all or part of the recited methods, may be a part of the recited systems, and/or may operate according to instructions in the recited tangible computer-readable storage devices. Such logical operations may be implemented as modules configured to control processor 202 to perform particular functions according to the programming of software modules 216, 218, and 220.

Figure 3:
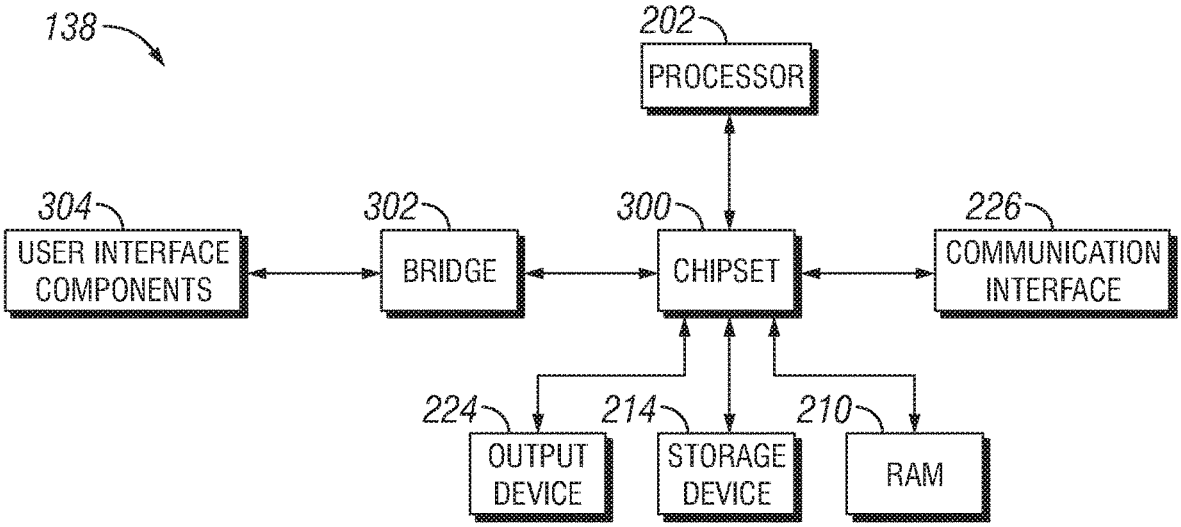
FIG. 3 is another schematic view of the information handling system.

In examples, one or more parts of the example information handling system 138, up to and including the entire information handling system 138, may be virtualized. For example, a virtual processor may be a software object that executes according to a particular instruction set, even when a physical processor of the same type as the virtual processor is unavailable. A virtualization layer or a virtual "host" may enable virtualized components of one or more different computing devices or device types by translating virtualized operations to actual operations. Ultimately however, virtualized hardware of every type is implemented or executed by some underlying physical hardware. Thus, a virtualization compute layer may operate on top of a physical compute layer. The virtualization compute layer may include one or more virtual machines, an overlay network, a hypervisor, virtual switching, and any other virtualization application FIG. 3 illustrates an example information handling system 138 having a chipset architecture that may be used in executing the described method and generating and displaying a graphical user interface (GUI) in accordance with some embodiments. Information handling system 138 is an example of computer hardware, software, and firmware that may be used to implement the disclosed technology. Information handling system 138 may include a processor 202, representative of any number of physically and/or logically distinct resources capable of executing software, firmware, and hardware configured to perform identified computations. Processor 202 may communicate with a chipset 300 that may control input to and output from processor 202. In this example, chipset 300 outputs information to output device 224, such as a display, and may read and write information to storage device 214, which may include, for example, magnetic media, and solid state media. Chipset 300 may also read data from and write data to RAM 210. A bridge 302 for interfacing with a variety of user interface components 304 may be provided for interfacing with chipset 300. Such user interface components 304 may include a keyboard, a microphone, touch detection and processing circuitry, a pointing device, such as a mouse, and so on. In general, inputs to information handling system 138 may come from any of a variety of sources, machine generated and/or human generated.

Chipset 300 may also interface with one or more communication interfaces 226 that may have different physical interfaces. Such communication interfaces may include interfaces for wired and wireless local area networks, for broadband wireless networks, as well as personal area networks. Some applications of the methods for generating, displaying, and using the GUI disclosed herein may include receiving ordered datasets over the physical interface or be generated by the machine itself by processor 202 analyzing data stored in storage device 214 or RAM 210. Further, information handling system 138 receive inputs from a user via user interface components 304 and execute appropriate functions, such as browsing functions by interpreting these inputs using processor 202.

In examples, information handling system 138 may also include tangible and/or non-transitory computer-readable storage devices for carrying or having computer-executable instructions or data structures stored thereon. Such tangible computer-readable storage devices may be any available device that may be accessed by a general purpose or special purpose computer, including the functional design of any special purpose processor as described above. By way of example, and not limitation, such tangible computer-readable devices may include RAM, ROM, EEPROM, CD-ROM or other optical disk storage, magnetic disk storage or other magnetic storage devices, or any other device which may be used to carry or store desired program code in the form of computer-executable instructions, data structures, or processor chip design. When information or instructions are provided via a network, or another communications connection (either hardwired, wireless, or combination thereof), to a computer, the computer properly views the connection as a computer-readable medium. Thus, any such connection is properly termed a computer-readable medium. Combinations of the above should also be included within the scope of the computer-readable storage devices.

Computer-executable instructions include, for example, instructions and data which cause a general purpose computer, special purpose computer, or special purpose processing device to perform a certain function or group of functions. Computer-executable instructions also include program modules that are executed by computers in standalone or network environments. Generally, program modules include routines, programs, components, data structures, objects, and the functions inherent in the design of special-purpose processors, etc. that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described in such steps.

In additional examples, methods may be practiced in network computing environments with many types of computer system configurations, including personal computers, hand-held devices, multi-processor systems, microprocessor-based or programmable consumer electronics, network PCs, minicomputers, mainframe computers, and the like. Examples may also be practiced in distributed computing environments where tasks are performed by local and remote processing devices that are linked (either by hardwired links, wireless links, or by a combination thereof) through a communications network. In a distributed computing environment, program modules may be located in both local and remote memory storage devices During drilling operations information handling system 138 may process different types of the real time data originated from varied sampling rates and various sources, such as diagnostics data, sensor measurements, operations data, and or the like through one or more sensors 136 disposed at any suitable location within and/or on RSS 130. (e.g., referring to FIG. 1). These measurements from one or more sensors 136 may allow for information handling system 138 to assist the constant curvature generating during drilling operation while drilling a curve section of borehole 102. In examples, attitude measurements form one or more sensors 136 that may be spatially distributed along BHA 134 may be used to regulate steering commands provided to a tool-face controller disposed within or on RSS 130.

Figure 4:
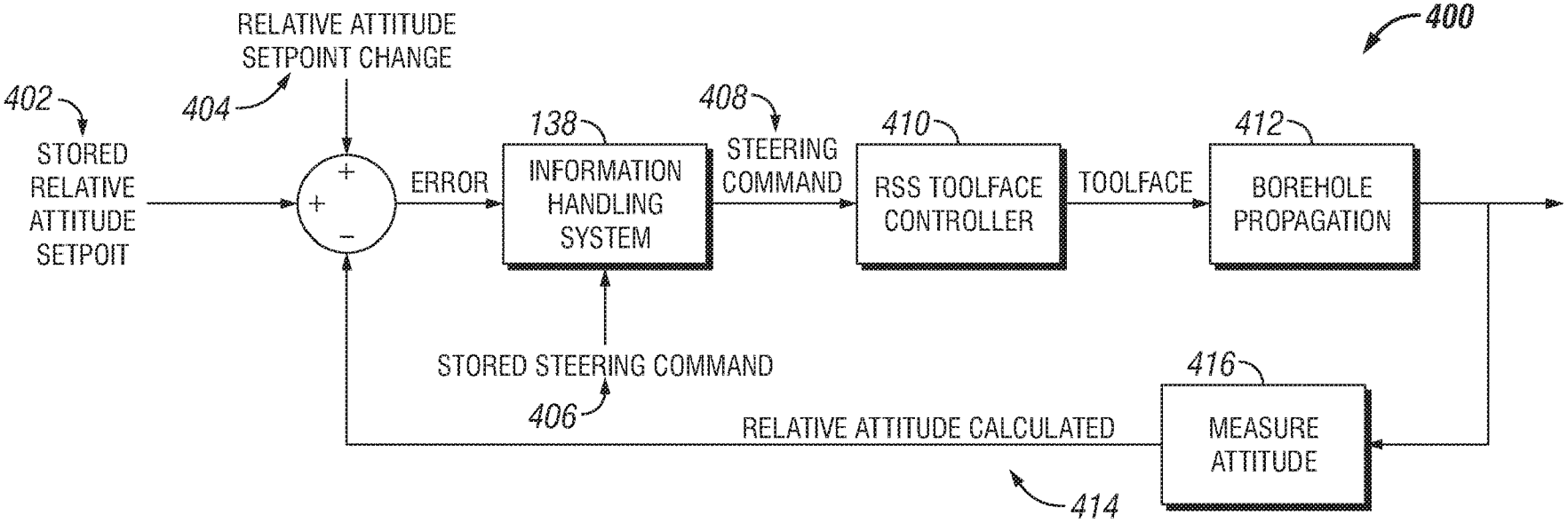
FIG. 4 is a block diagram for controlling a curvature of a borehole.

FIG. 4 illustrates a block diagram 400 for controlling a curvature of borehole 102 in accordance in accordance with some embodiments. As illustrated, several inputs may be placed within information handling system 138. For example, input 402 may be a stored relative attitude setpoints for forming a curvature of borehole 102 (e.g., referring to FIG. 1) during drilling operations. The stored relative attitude setpoint may be set by personnel before drilling operations in a drill plan. During drilling operations, an input 404 may be received, input 404 may be a relative attitude setpoint change. Both input 404 and input 402 may be compared to determine an "error." The error may be calculated by subtracting a calculated relative attitude, discussed below, from a relative attitude setpoint. The relative attitude setpoint is input 402 added to input 404. This error may be feed into information handling system 138. Additionally, input 406, which may be stored steering commands for drilling operations, may be put into information handling system 138. Information handling system 138 may determine the corrections needed for RSS 130 (e.g. referring to FIG. 1) to hit additional relative attitude setpoints from input 402. These corrections may be transmitted from information handling system 138 as steering commands 408 to RSS toolface controller 410. RSS toolface controller 410 may adjust RSS 130 during drilling operations to alter the drill path of RSS 130. In block 412, propagation of borehole 102 is altered based at least in part on the adjustments made by RSS 130. In feedback loop 414, one or more sensors 136 measure attitude in block 416. This measurement is added to input 402 and input 404 to determine "error," which is fed back into information handling system 138. Feedback loop 414 allows for RSS 130 to constantly update the drill path during drilling operations, which may allow for the creation and real time control of a curvature of borehole 102.

Figure 5:
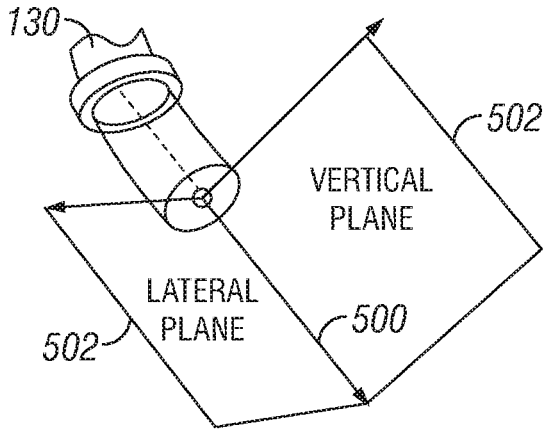
FIG. 5 illustrates another method for controlling a curvature of the borehole.
Figure 6:
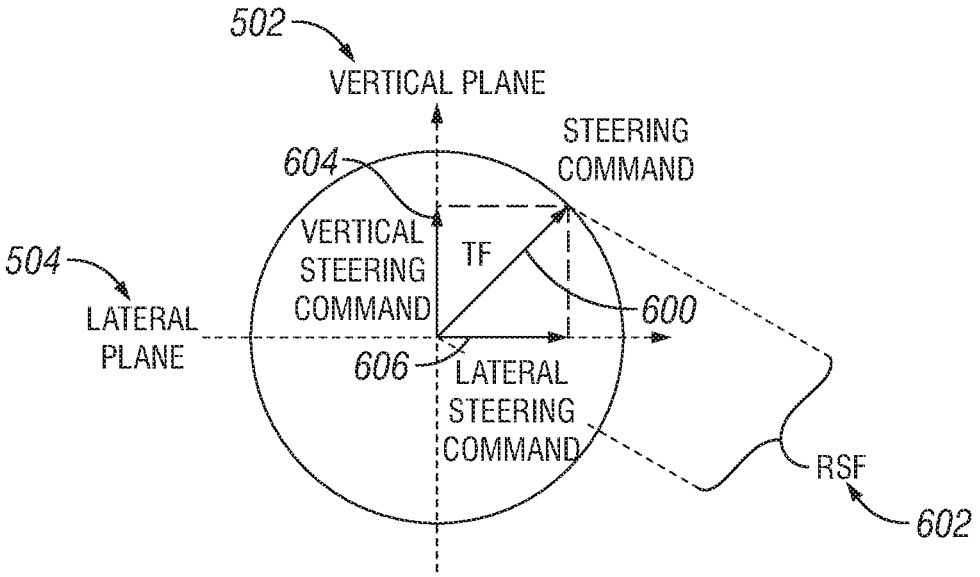
FIG. 6 illustrates calculations used to determine toolface and resultant steering force.

FIG. 5 illustrates another method for controlling a curvature of borehole 102 (e.g., referring to FIG. 1) in accordance with some embodiments. As illustrated, the direction of curvature 500 formed by RSS 130 may be broken into a vertical plane 502 and a lateral plane 504. Vertical plane 502 and lateral plane 504 may be found from inclination and azimuth measurements, respectively, by one or more measurements from one or more sensors 136 (e.g., referring to FIG. 1). FIG. 6 utilizes measurements for vertical plane 502 and lateral plane 504 may be used to calculate toolface (TF) 600 and resultant steering force (RSF) 602 in accordance with some embodiments. RSF 602 is a term used as proxy for the magnitude of actuation required to steer RSS 130 in a designated direction. Additionally, the magnitude of vertical steering command 604 and the magnitude of lateral steering command 606 is used to form TF 600. Both TF 600 and RSF 602 may be calculated as follows, given lateral steering command 606 and vertical steering commands 604:

$$RSF = \sqrt{(\text{Lateral Steering Command})^2 + (\text{Vertical Steering Command})^2} \quad (1)$$

$$TF = \tan^{-1}\left(\frac{\text{Lateral Steering Command}}{\text{Vertical Steering Command}}\right) \quad (2)$$

Figure 7:
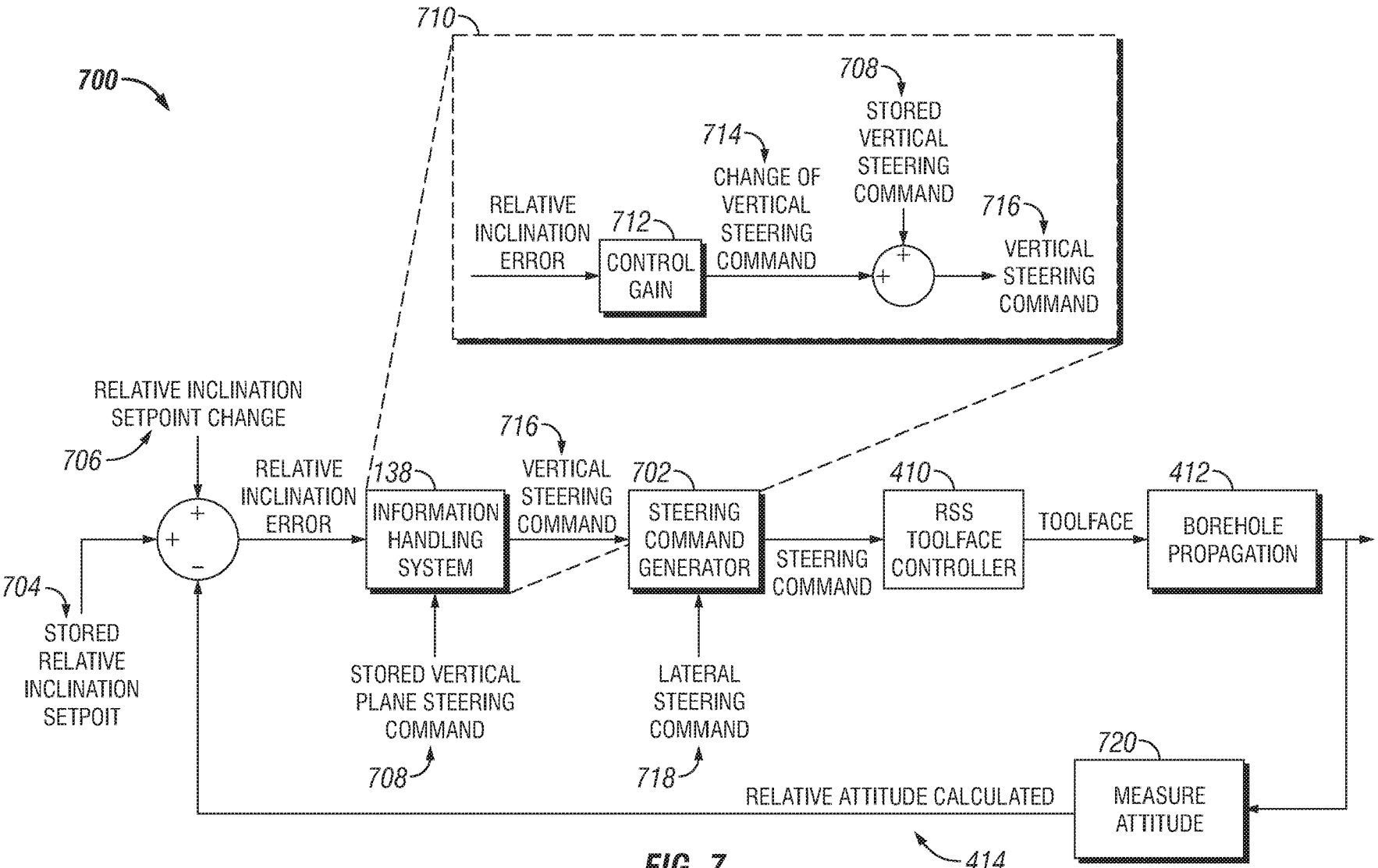
FIG. 7 is another block diagram for controlling a curvature of the borehole.

FIG. 7 illustrates a block diagram 700 for controlling a curvature of the borehole with RSS 130 in accordance with some embodiments. In examples, block diagram 700 may include a steering command generator 702, which separates it from block diagram 400. As illustrated in FIG. 7, several inputs may be placed within information handling system 138. For example, input 704 may be a stored relative inclination setpoints for forming a curvature of borehole 102 (e.g., referring to FIG. 1) during drilling operations. The stored relative inclination setpoints may be set by personnel before drilling operations in a drill plan. During drilling operations, an input 706 may be received, input 706 may be a relative inclination setpoint change. Both input 704 and input 706 may be compared to determine error, as discussed above. Additionally, input 704 may be stored as $\Delta I_0$ (here subscript $(\ )_0$ represents a stored value), and the vertical plane steering command (VSC) is calculated as:

$$VSC_0 = RSF_0 \times \cos(TF_0) \quad (3)$$

It may be calculated as simple as the difference between two inclination measurements that are spatially distributed on BHA 134 (e.g., referring to FIG. 1) as:

$$\Delta I_0 = I_{1_0} - I_{2_0} \quad (4)$$

or it may be a filtered value for smoother calculation:

$$\Delta I_0 = f(i_{1_0} - I_{2_0}) \quad (5)$$

Similarly, relative inclination is calculated while drilling as $\Delta I$, and the relative inclination error is calculated as:

$$\in_1 = \Delta I_0 - \Delta I \quad (6)$$

This may be the inclination difference between a set point designated in formation 106 from input 704 and where BHA 134 (e.g., referring to FIG. 1) is in formation 106. Thus, the error may be calculated by subtracting calculated relative inclination, discussed below, from relative inclination setpoint. The relative inclination setpoint is input 704 plus input 706. This error may be feed into information handling system 138. Additionally, input 708, which may be stored vertical plane steering commands for drilling operations, may be loaded on information handling system 138 as an input. The vertical plane steering commands may be the last steering command before steering command generator 702 is activated.

Information handling system 138 may operate according to block diagram 710. As illustrated in block 710, error is input into gain controller 712. During operations, gain controller 712 operates by multiplying error, where the error is relative inclination error. For example, output 714 change of vertical steering command is formed by gain controller 712 by the following mathematical expression of $$K \times \text{error} \quad (7)$$

where K is defined as the proportional gain controller. The gain may depend at least in part on the curvature generating capability of RSS 130 (e.g., referring to FIG. 1) and may be configured from the surface by communication link 140 (e.g., referring to FIG. 1). It may also be a function of inclination, formation 106 (e.g., referring to FIG. 1) and the drilling parameters such as weight on bit, flow rate, and/or the like. In examples, gain controller 713 may be a proportional (P) gain controller or a more complex control that may include integral (I) and derivative (D) gains.

Gain controller 712 sends output 714, change of vertical steering command, which is added to input 708. Input 708 and output 714 are added together to determine output 716 or vertical steering command, which is input into steering command generator 702. In examples, lateral steering command 606 (e.g., referring to FIG. 6) may also be calculated with a hold relative azimuth logic. In examples, the lateral steering command 606 may be calculated with a logic seen in Table 1. During this operation gain controller value, in gain controller 712, is a function of inclination. Steering command generator 702 additionally takes input 718 of lateral steering command. The lateral steering command for input 718 may be given manually or may be Lateral Place control options in Table 1, discussed below. Input 708 and output 714 are combined into steering command 408. Steering command is sent to RSS toolface controller 410. RSS toolface controller 410 may adjust RSS 130 during drilling operations to alter the drill path of RSS 130 (e.g., referring to FIG. 1). In block diagram 700, propagation of borehole 102 (e.g., referring to FIG. 1) is altered based at least in part on the adjustments made by RSS 130. In feedback loop 414, one or more sensors 136 (e.g., referring to FIG. 1) measure inclination in block 720. This measurement is added to input 704 and input 706 to determine "error," which is fed back into information handling system 138. Feedback loop 414 allows for RSS 130 to constantly update the drill path during drilling operations, which may allow for the creation and real time control of a curvature of borehole 102. From block diagram 400 or block diagram 700, various modes may be performed during drilling operations, as illustrated below in Table 1. These modes may be used to steer RSS 130 (e.g., referring to FIG. 1) in both a vertical and a lateral direction. As illustrated in FIG. 7, the mode for Hold Relative Inclination for Vertical Control is used. For Lateral Control, the modes for either Hold Relative Azimuth control, Hold Azimuth control, or Manual Control may be used. It should be noted that, "Hold Azimuth" will strictly keep the Azimuth measurements in a specific vicinity, such as a vector of 140 deg (or any chosen degree). "Hold Relative Azimuth" is not for holding a certain azimuth angle, but for holding a change of angle or curvature. For example, maintaining 4 deg of change every 100 ft to the right consistently. These modes may cover operational modes where the Relative azimuth or inclination hold control modes may be used along with other types of control methods. Each row in Table 1 shows possible options.

TABLE 1

| Vertical Plane Control | Lateral Plane Control |
|---|---|
| Hold Relative Inclination | Manual |
| Hold Relative Inclination | Hold Azimuth |
| Manual | Hold Relative Azimuth |
| Hold Inclination | Hold Relative Azimuth |
| Hold Relative Inclination | Hold Relative Azimuth |

Figure 8:
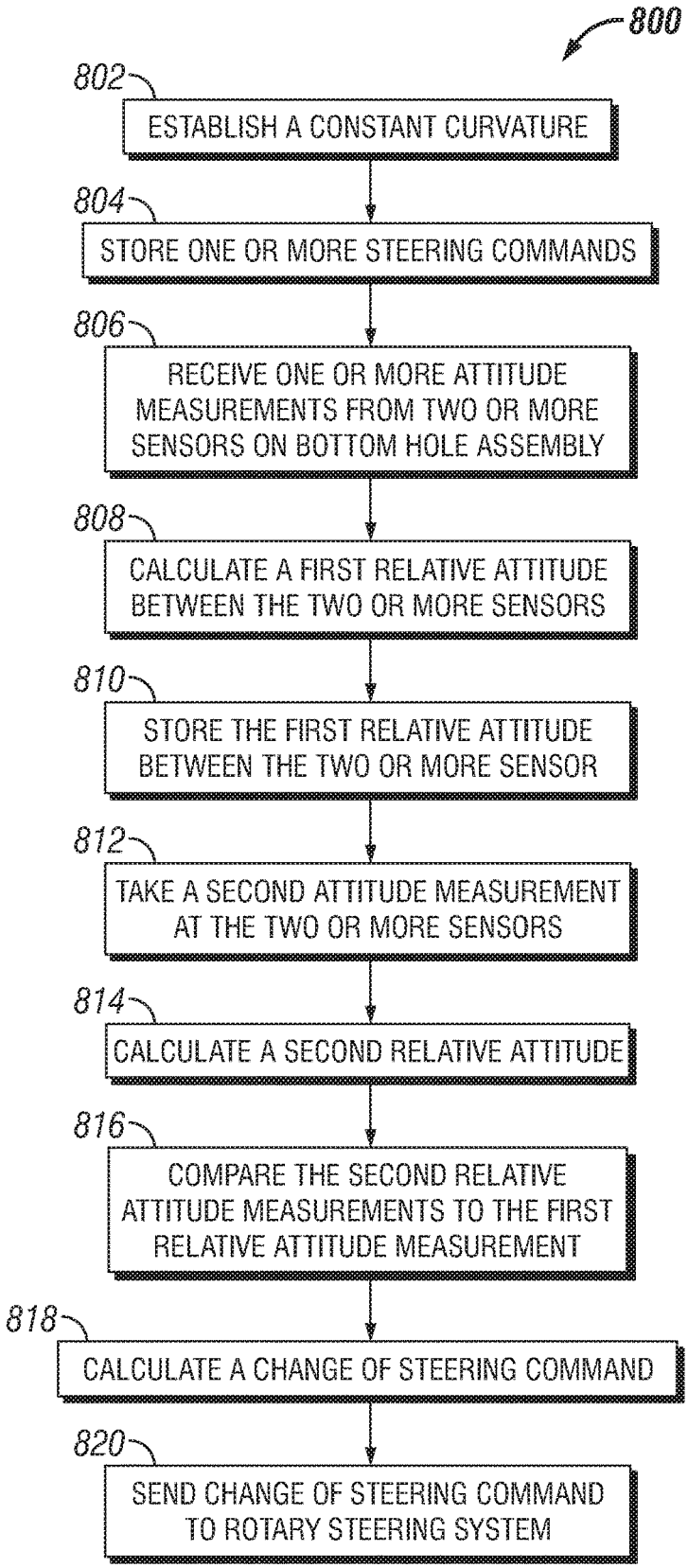
FIG. 8 is a workflow for an automated assisted method to drill a constant curvature for the borehole.

FIG. 8 illustrates workflow 800 for an automated assisted method to drill a constant curvature for borehole 102 (e.g., referring to FIG. 1) in accordance with some embodiments. Workflow 800 is the methods used for block diagram 400

(e.g., referring to FIG. 4) and block diagram 700 (e.g., referring to FIG. 7). As illustrated, workflow 800 begins with block 802, to establish a constant curvature for a borehole 102. A curve formed from constant curvature operations is formed by sending steering commands to the tool, the curve is based at least in part on a well plan. During operations, activating steering command generator 702 (e.g., referring to FIG. 7) the controller after establishing a curvature in block 802, not further inputs from personnel may be necessary. In other examples, before drilling operation, an initial constant curvature may be programmed by personnel into information handling system 138. It should be noted that information handling system 138 may be disposed downhole on RSS 130 or BHA 134. In block 804, the one or more steering commands are stored on information handling system 138. For example, steering commands may be used to drill the wellbore with RSS 130. Steering commands may be manually selected from the surface and downlinked to RSS 130, or may be computed automatically downhole. In block 804, after activating steering command generator 702 the last toolface and steering command that were used to establish the curvature drilled may be used. Table 1 includes modes from which the steering commands are generated.

In block 806, one or more attitude measurements at a first location are taken from two or more sensors disposed at any suitable location on BHA 134 (e.g., referring to FIG. 1). For example, at one moment in time ($t_1$), an attitude measurement is made at each sensor. At that moment in time a first attitude measurement may be taken at a first sensor and a second sensor. In block 808, a first relative attitude is calculated from the attitude measurements from each sensor. For example, the measurement from the second sensor may be subtracted from the measurement at the first sensor, or vice versa, to determine the first relative attitude measurement. In block 810 the first relative attitude is stored in information handling system 138.

In block 812 a second attitude measurement is taken at the one or more sensors 136. It should be noted that drilling operations have moved RSS 130 within formation 106 (e.g., referring to FIG. 1) from the first location in which the first relative attitude measurement were made to a second location. For example, at one moment in time ($t_2$), an measurements are made at each sensor. At that moment in time a second attitude measurement may be taken at the first sensor and the second sensor. Similar to block 806, however RSS 130 has moved to a second location, thus the measurements at the second location will be different at the first sensor and the second sensor. In block 814 a second relative attitude is calculated in the same manner as discussed in block 808, where the second relative attitude is calculated from the attitude measurements from each sensor. For example, the measurement from the second sensor may be subtracted from the measurement at the first sensor, or vice versa, to determine the second relative attitude measurement, at the second location. It should be noted that in blocks 802-814, control commands may not be generated by information handling system 138. Next, in block 816 the second relative attitude calculation from block 814 are compared to the first relative attitude calculation from block 808. In block 818 a change of steering command is calculated, as discussed above in block 710, based on the comparison from block 816. The change of steering command from block 818 is sent to RSS 130 in block 820. In block 820, RSS 130 changes direction based on the change of steering commands. The steering commands may be implemented by the tool-face controller on RSS 130. Blocks 812 to 820 may be repeated any number of times during drilling operations to form a curvature in borehole 102. The repeated blocks may continue until the curvature for borehole 102 has been completed.

Figure 9:
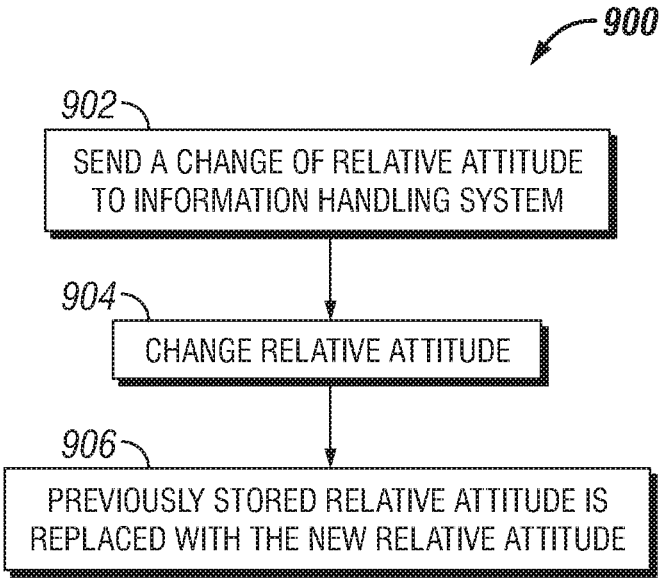
FIG. 9 is a workflow for altering the curvature of the borehole.

During drilling operations, workflow 900, illustrated in FIG. 9, may be used to alter the curvature of borehole 102 (e.g., referring to FIG. 1) in accordance with some embodiments. Workflow 900 is the methods used for block diagram 400 (e.g., referring to FIG. 4) and block diagram 700 (e.g., referring to FIG. 7). As illustrated, workflow 900 may begin with block 902. In block 902, a change of relative attitude is sent to information handling system 138 (e.g., referring to FIG. 1) by personnel. In block 904 a new relative attitude is created. The new relative attitude is based at least in part on adjustments to the stored relative attitude that was changed in block 902. In block 906, the previously stored relative attitude is replaced with the new relative attitude. The new relative attitude may be used to steering commands may be implemented by the tool-face controller on RSS 130 (e.g. referring to FIG. 1).

The systems and methods described above are an improvement over current technology. For example, current technology drills with RSS by sending steering commands from the surface occasionally. Since there is bandwidth limitations with how often corrections may be made. Additionally, there are delays due to transmission of the measurements uphole and commands downhole, which may alter drilling trajectory.

By using downhole control capability that will run at a significant faster rate, any deviation from constant curvature may be controlled in a more timely manner and thus smoother and more accurate wellbores may be drilled. The systems and methods may include any of the various features of the systems and methods disclosed herein, including one or more of the following statements.

Statement 1. A method for controlling a rotary steerable system (RSS) may comprise disposing the RSS into a borehole, storing a curvature for the borehole into an information handling system, wherein the information handling system is disposed on the RSS, storing one or more steering commands in the information handling system, taking a first attitude measurement at a first sensor and a second sensor disposed on the RSS at a first location in the borehole, and calculating a first relative attitude from the first attitude measurement at the first sensor and the second sensor. The method may further comprise moving the RSS in the borehole to a second location, taking a second attitude measurement at the first sensor and the second sensor disposed on the RSS at the second location in the borehole, calculating a second relative attitude from the second attitude measurement at the first sensor and the second sensor, comparing the first relative attitude to the second relative attitude to find a difference, preparing a change of steering command based at least in part on the difference, adjusting the RSS based on the change of steering command, and drilling in a direction with the RSS based at least in part on the change of steering command.

Statement 2. The method of statement 1, wherein the one or more steering commands includes a vertical plane control and a lateral plane control.

Statement 3. The method of statement 2, wherein the vertical plane control is hold relative inclination mode the lateral plane control is in manual mode, hold azimuth mode, or hold relative azimuth mode.

Statement 4. The method of statement 2, wherein the vertical plane control is in manual mode the lateral plane control is in hold relative azimuth mode.

Statement 5. The method of statement 2, wherein the vertical plane control is in hold inclination mode the lateral plane control is in hold relative azimuth mode.

Statement 6. The method of statements 1 or 2, wherein the information handling system is disposed on the RSS.

Statement 7. The method of statement 6, wherein the comparing the first relative attitude to the second relative attitude to find the difference is performed automatically by the information handling system.

Statement 8. The method of statement 7, wherein adjusting the RSS based on the change of steering command is performed automatically by the information handling system.

Statement 9. A system for controlling a rotary steerable system (RSS) may comprise an information handling system which includes a gain controller, a steering command generator connected to the information handling system, a RSS toolface controller connected to the steering command generator, and a RSS that is connected to the RSS toolface controller.

Statement 10. The system of statement 9, further comprising a first sensor and a second sensor disposed on the RSS.

Statement 11. The system of statement 10, wherein the first sensor and the second sensor are configured to take a first attitude measurement at a first location within a formation.

Statement 12. The system of statement 11, wherein the information handling system is configured to calculate a first relative attitude from the first attitude measurement at the first sensor and the second sensor.

Statement 13. The system of statement 12, wherein the first sensor and the second sensor are configured to take a second attitude measurement at a second location.

Statement 14. The system of statement 13, wherein the information handling system is configured to calculate a second relative attitude from the second attitude measurement at the first sensor and the second sensor.

Statement 15. The system of statement 14, wherein the information handling system is configured prepare a change of steering commands from comparing the first relative attitude to the second relative attitude.

Statement 16. The system of statement 9 or 10, wherein the gain controller is a proportional gain controller that multiplies a relative inclination error.

Statement 17. The system of statement 16, wherein the relative inclination error is a calculated relative inclination subtracted from a relative inclination setpoint.

Statement 18. The system of statement 17, wherein the relative inclination setpoint is a stored relative inclination setpoint added to a relative attitude setpoint change.

Statement 19. The system of statement 16, wherein the gain controller a combination of an integral (I) controller or a derivative (D) controller.

Statement 20. The system of statement 16, wherein the gain controller at least in part is used part to prepare a change of steering commands for the RSS.

The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A method for controlling a rotary steerable system (RSS) comprising:

disposing the RSS into a borehole;

storing a curvature for the borehole into a downhole information handling system disposed on the RSS;

storing one or more steering commands in the downhole information handling system;

taking a first attitude measurement at a first sensor and a second sensor disposed on the RSS at a first location in the borehole;

calculating a first relative attitude from the first attitude measurement at the first sensor and the second sensor, on the downhole information handling system;

moving the RSS in the borehole to a second location;

taking a second attitude measurement at the first sensor and the second sensor disposed on the RSS at the second location in the borehole;

calculating a second relative attitude from the second attitude measurement at the first sensor and the second sensor, on the downhole information handling system;

comparing the first relative attitude to the second relative attitude to find a difference; determining one or more steering commands based at least in part on the difference and a feed-back loop, wherein the steering commands are determined on the downhole information handling system, wherein the one or more steering commands include a vertical plane control and a lateral plane control, wherein the vertical plane control comprises an inclination and the lateral plane control comprises an azimuth, wherein at least one of the inclination and the azimuth are hold relative, and wherein the feed-back loop is a closed-loop;

adjusting the RSS based on the one or more steering commands; and drilling in a direction with the RSS based at least in part on the one or more steering commands.

2. The method of claim 1, wherein the vertical plane control is hold relative inclination mode and the lateral plane control is in manual mode, hold azimuth mode, or hold relative azimuth mode.

3. The method of claim 1, wherein the vertical plane control is in manual mode and the lateral plane control is in hold relative azimuth mode.

4. The method of claim 1, wherein the vertical plane control is in hold inclination mode and the lateral plane control is in hold relative azimuth mode.

5. The method of claim 1, wherein the downhole information handling system is disposed on the RSS.

6. The method of claim 5, wherein the comparing the first relative attitude to the second relative attitude to find the difference is performed automatically by the downhole information handling system.

7. The method of claim 6, wherein adjusting the RSS based on the change of steering command is performed automatically by the downhole information handling system.

8. The method of claim 1, wherein the lateral plane control is hold relative azimuth mode and the vertical plane control is in manual mode, hold inclination mode, or hold relative inclination mode.

9. The method of claim 1, wherein the lateral plane control is hold relative azimuth mode and the vertical plane control is in hold relative inclination mode.

10. A system for controlling a rotary steerable system (RSS) comprising:

a downhole information handling system which includes a gain controller;

a steering command generator connected to the downhole information handling system, wherein the steering commands are generated downhole;

an RSS toolface controller connected to the steering command generator;

a first sensor and a second sensor disposed on the RSS, wherein the first sensor and the second sensor are spatially distributed on the RSS, wherein the first sensor and the second sensors are attitude sensors configured to take a first attitude measurement at a first location, wherein the first and second sensors are configured to take a second attitude measurement at a second location, and wherein the downhole information handling system is configured to calculate a first relative attitude from the first attitude measurement, calculate a second relative attitude from the second attitude measurement, compare the first relative attitude to the second relative attitude to find a difference, and determine one or more steering commands based at least in part on the difference; and an RSS that is connected to the RSS toolface controller, wherein the downhole information handling system is disposed on the RSS.

11. The system of claim 10, wherein the first sensor and the second sensor are configured to take the first attitude measurement at the first location within a formation.

12. The system of claim 11, wherein the downhole information handling system is configured to calculate the first relative attitude from the first attitude measurement at the first sensor and the second sensor.

13. The system of claim 12, wherein the first sensor and the second sensor are configured to take the second attitude measurement at the second location.

14. The system of claim 13, wherein the downhole information handling system is configured to calculate the second relative attitude from the second attitude measurement at the first sensor and the second sensor.

15. The system of claim 14, wherein the downhole information handling system is configured prepare a change of steering commands from comparing the first relative attitude to the second relative attitude.

16. The system of claim 10, wherein the gain controller is a proportional gain controller that multiplies a relative inclination error.

17. The system of claim 16, wherein the relative inclination error is a calculated relative inclination subtracted from a relative inclination setpoint.

18. The system of claim 17, wherein the relative inclination setpoint is a stored relative inclination setpoint added to a relative attitude setpoint change.

19. The system of claim 16, wherein the gain controller a combination of an integral (I) controller or a derivative (D) controller.

20. The system of claim 16, wherein the gain controller at least in part is used part to prepare a change of steering commands for the RSS.

* * * * *